US005456010A

United States Patent [19]

Bryda

[11] Patent Number: 5,456,010

[45] Date of Patent: Oct. 10, 1995

[54] KITCHEN DEVICE WITH COVER FOR CHOPPING AND CUTTING

[76] Inventor: Frank S. Bryda, R.R. 1, Box 354, Brockhill Rd., Grafton, N.H. 03240

[21] Appl. No.: 160,669

[22] Filed: Dec. 2, 1993

[51] Int. Cl.[6] ..... B26B 3/04; B26B 5/00; B26B 29/00

[52] U.S. Cl. ..... 30/287; 30/286; 30/305; 30/312; 83/574; 83/582

[58] Field of Search ..... 83/574, 588, 611, 83/607, 608, 582, 586; 30/279.2, 286, 287, 299, 304, 305, 315, 114, 312; D7/381, 693

[56] References Cited

U.S. PATENT DOCUMENTS

| | | | |
|---|---|---|---|
| 157,516 | 12/1874 | Heineman | 30/304 |
| 717,223 | 12/1902 | Leachman | 30/304 X |
| 1,110,946 | 9/1914 | Lahi`ere | 30/305 |
| 1,531,314 | 3/1925 | Simberg et al. | 30/305 X |
| 1,614,282 | 1/1927 | Cleary | 30/304 X |
| 1,991,546 | 2/1935 | Czapar, Jr. | 30/304 |
| 2,396,443 | 3/1946 | Singer | 30/304 |
| 3,231,973 | 2/1966 | Veskrna | 30/305 |

FOREIGN PATENT DOCUMENTS

| | | | |
|---|---|---|---|
| 1073245 | 9/1954 | France | 30/287 |
| 214910 | 10/1909 | Germany | 30/304 |

*Primary Examiner*—Richard K. Seidel
*Assistant Examiner*—Clark F. Dexter

[57] ABSTRACT

A food chopper and slicer knife mechanism for kitchen use comprising an elongated central blade of an extended length having a handle formed at each opposite end and a pair of internally spaced holes extending through the blade on opposite sides of the center of the central blade; a plurality of smaller supplemental blades positionable on opposite sides of the central blade and oriented parallel therewith, the supplemental blades each having a pair of laterally spaced holes extending therethrough on opposite sides of their centers, the central blade and supplemental blades having aligned cutting edges which are aligned parallel with one another when the holes are aligned about common axes; coupling components including a pair of threaded rods, each positionable through each of the aligned holes of the central and supplemental blades with locking knobs positionable at the ends of the rods; and cylindrical spacer disks positionable on the rods between adjacent blades.

2 Claims, 4 Drawing Sheets

KITCHEN DEVICE WITH COVER FOR CHOPPING AND CUTTING

BACKGROUND OF THE INVENTION

1. Field of the Invention

The present invention relates to kitchen devices for chopping and cutting and more particularly pertains to a device with plural parallel blades for the more efficiently chopping and cutting of foods.

2. Description of the Prior Art

The use of kitchen devices for chopping and cutting are known in the prior art. More specifically, kitchen devices for chopping and cutting heretofore devised and utilized for the purpose of chopping and cutting are known to consist basically of familiar, expected, and obvious structural configurations, notwithstanding the myriad of designs encompassed by the crowded prior art which has been developed for the fulfillment of countless objectives and requirements.

The prior art discloses a large number of kitchen devices for chopping and cutting. By way of example, the prior art discloses in U S Pat. Nos. 3,667,519 and 4,572,444 to Shadduck disclose cylindrical devices with chopping blades.

U.S. Pat. Nos. 3,647,360 to Seydelmann and 3,907,215 to Mantelet disclose hand cranked machines for chopping food.

U.S. Pat. No. 3,696,849 to Davis discloses a knife-like device with parallel blades for chopping food.

In this respect, the kitchen device for chopping and cutting according to the present invention substantially depart from the conventional concepts and designs of the prior art, and in doing so provide an apparatus primarily developed for the purpose of chopping and cutting.

Therefore, it can be appreciated that there exists a continuing need for new and improved kitchen devices which can be used for chopping and cutting. In this regard, the present invention substantially fulfills this need.

SUMMARY OF THE INVENTION

In view of the foregoing disadvantages inherent in the known types of kitchen devices for chopping and cutting now present in the prior art, the present invention provides an improved device for chopping and cutting. As such, the general purpose of the present invention, which will be described subsequently in greater detail, is to provide a new and improved kitchen device for chopping and cutting and method which has all the advantages of the prior art and none of the disadvantages.

To attain this, the present invention essentially comprises a food chopper and slicer knife mechanism for kitchen use comprising, in combination, an elongated central blade of an extended length having a handle formed at each opposite end and a pair of internally spaced holes extending through the blade on opposite sides of the center of the central blade; a plurality of smaller supplemental blades positionable on opposite sides of the central blade and oriented parallel therewith, the supplemental blades each having a pair of laterally spaced holes extending therethrough on opposite sides of their centers, the central blade and supplemental blades having aligned cutting edges which are aligned parallel with one another when the holes are aligned about common axes; coupling means including a pair of threaded rods, each positionable through each of the aligned holes of the central and supplemental blades with locking knobs positionable at the ends of the rods; cylindrical spacer disks of a common length positionable on the rods between adjacent blades; a transparent housing having an upper wall and depending side walls with upwardly extending recesses formed in the side walls to receive the ends of the central blade; and a mounting post with a spring downwardly biassing a piston and an associated clevis pivotally coupling one handle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved kitchen devices for chopping and cutting which have all the advantages of the prior art kitchen devices for chopping and cutting and none of the disadvantages.

It is another object of the present invention to provide new and improved kitchen devices for chopping and cutting which may be easily and efficiently manufactured and marketed.

It is further object of the present invention to provide new and improved kitchen devices for chopping and cutting which are of durable and reliable constructions.

An even further object of the present invention is to provide new and improved kitchen devices for chopping and cutting which are susceptible of a low cost of manufacture with regard to both materials and labor, and which accordingly are then susceptible of low prices of sale to the consuming public, thereby making such kitchen device for chopping and cutting economically available to the buying public.

Still yet another object of the present invention is to provide new and improved kitchen devices for chopping and cutting which provide in the apparatuses and methods of the prior art some of the advantages thereof, while simultaneously overcoming some of the disadvantages normally associated therewith.

Lastly, it is an object of the present invention to provide a new and improved food chopper and slicer knife mechanism for kitchen use comprising an elongated central blade of an extended length having a handle formed at each opposite end and a pair of internally spaced holes extending through the blade on opposite sides of the center of the central blade; a plurality of smaller supplemental blades positionable on opposite sides of the central blade and oriented parallel therewith, the supplemental blades each having a pair of laterally spaced holes extending therethrough on opposite sides of their centers, the central blade and supplemental blades having aligned cutting edges which are aligned parallel with one another when the holes are aligned about common axes; coupling means including a pair of threaded rods, each positionable through each of the aligned holes of the central and supplemental blades with locking knobs positionable at the ends of the rods; and cylindrical spacer disks positionable on the rods between adjacent blades.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
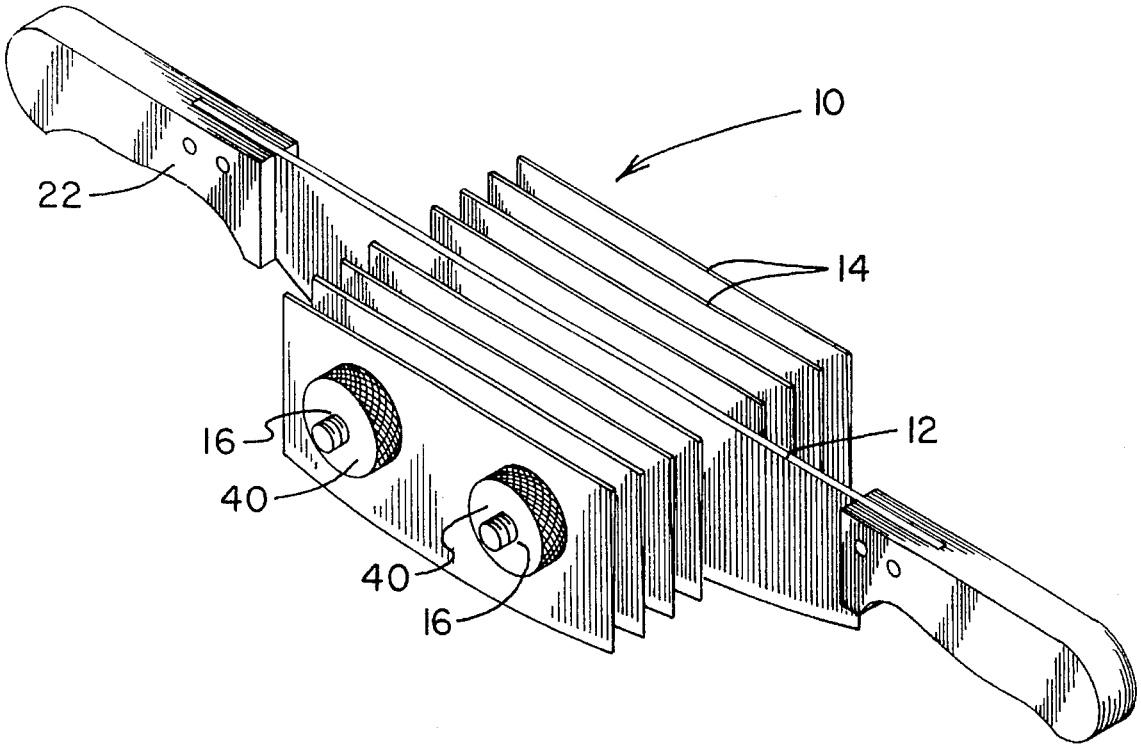
FIG. 1 is a perspective view of the preferred embodiment of the kitchen device for chopping and cutting constructed in accordance with the principles of the present invention.

With reference now to the drawings, and in particular to FIG. 1 thereof, the preferred embodiment of the new and improved kitchen device for chopping and cutting embodying the principles and concepts of the present invention and generally designated by the reference numeral 10 will be described.

As may be readily seen in FIG. 1 and the supplemental Figures, the present invention relates to a food chopping and slicing knife 10. Such knife is adapted for kitchen use. In its broadest context, the knife 10 is comprised of a plurality of components including a central blade 12, a plurality of smaller supplemental blades 14, coupling mechanisms 16 for the blades and centrally positioned spacer disks 18 between the blades.

More specifically, the knife includes a single elongated central blade 12. It is of an extended length and it is provided at its opposite end with handles 22. Also formed within the central blade are a pair of laterally disposed holes 24. The holes extend through the blade and are located on the opposite side of the center of the blade.

Used in association with the elongated central blade 12 are a plurality of smaller supplemental blades 14. The supplemental blades are positioned on opposite sides of the central blade 12. They are oriented parallel one to an other. The supplemental blades 14 each are provided with a pair of laterally disposed holes 28. Such holes 28 of the smaller blades extend through the blades 14. Like the holes of the central blade, they are each located on opposite sides of the center of the supplemental blade. The central blade 12 and supplemental blades 14 have aligned cutting edges 32 and 34. Such edges are aligned parallel, one with respect to the other, when the holes 24 and 28 are aligned about common axes.

The coupling means 16 for the blades are comprised of a plurality of components. Such components include a pair of rods 38, threaded at their ends. Each such rod is positionable through the aligned holes 24 and 28 of the supplemental and central blades 12 and 14. At the opposite ends of the coupling means are locking knobs 40. The locking knobs 40 are internally threaded for being received on the external threads at the ends of the rods 38.

Figure 2:
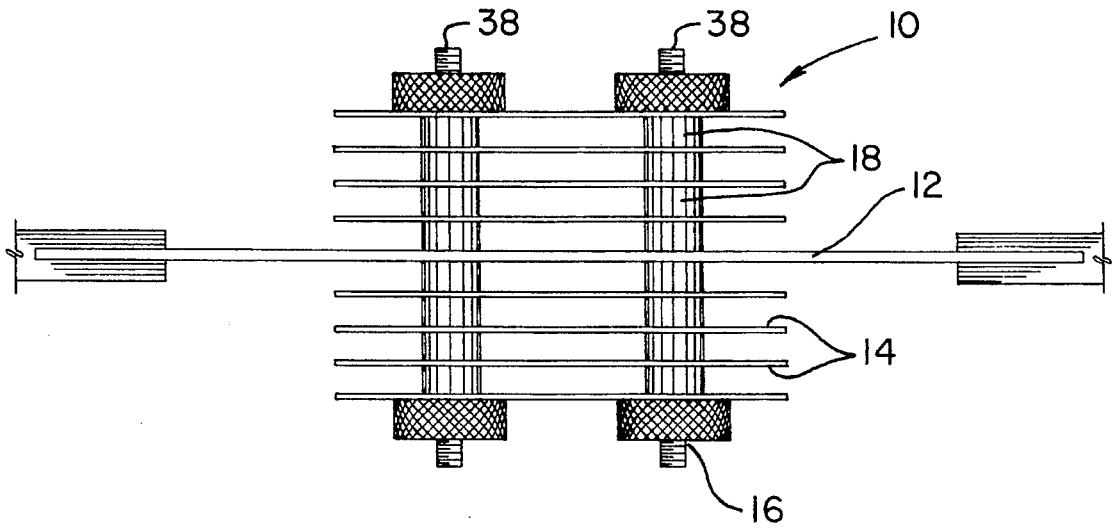
FIG. 2 is a top plan view of the kitchen device for chopping and cutting as shown in FIG. 1.
Figure 3:
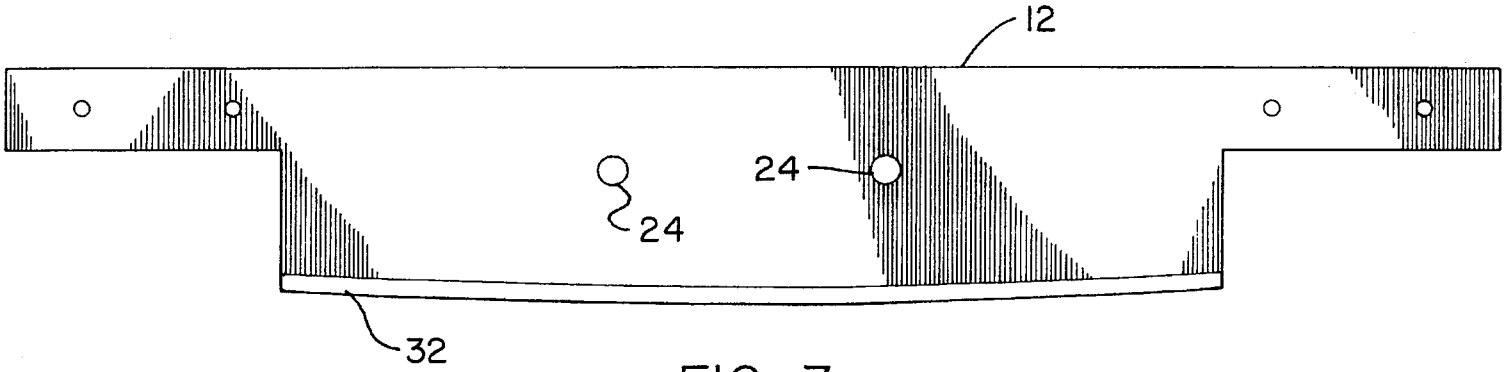
FIG. 3 is a plan view of the center blade as shown in FIGS. 1 and 2.
Figure 4:
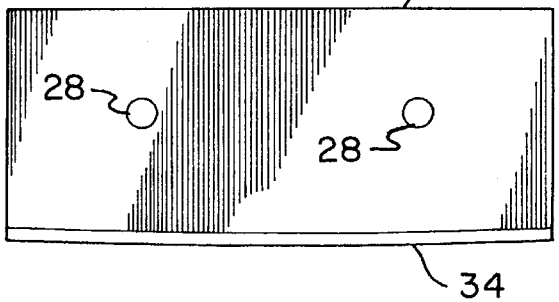
FIG. 4 is a plan view of one of the supplement blades as shown in FIGS. 1 and 2.
Figure 7:
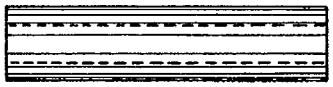
FIG. 7 is a plan view of a large size spacer for the kitchen device for chopping and cutting of FIGS. 1 and 2.
Figure 6:
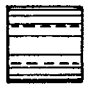
FIG. 6 is a plan view of an intermediate size spacer of the kitchen device for chopping and cutting of FIGS. 1 and 2.
Figure 5:
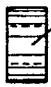
FIG. 5 is a plan view of a small spacer as shown in FIGS. 1 and 2.
Figure 8:
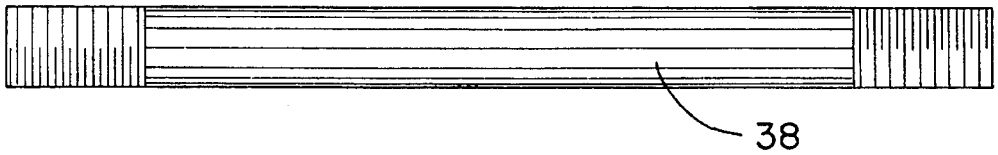
FIG. 8 is a plan view of one of the two central rods for the kitchen device for chopping and cutting of FIGS. 1 and 2.
Figure 9:
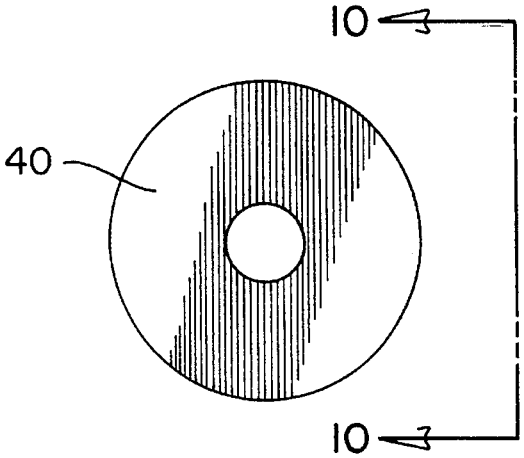
FIG. 9 is a plan view of one of the knurled nuts for the kitchen device for chopping and cutting as shown in FIGS. 1 and 2.
Figure 10:
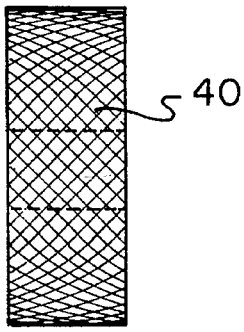
FIG. 10 is a side view of one of the knurled nuts taken along line 10—10 of FIG. 9.
Figure 11:
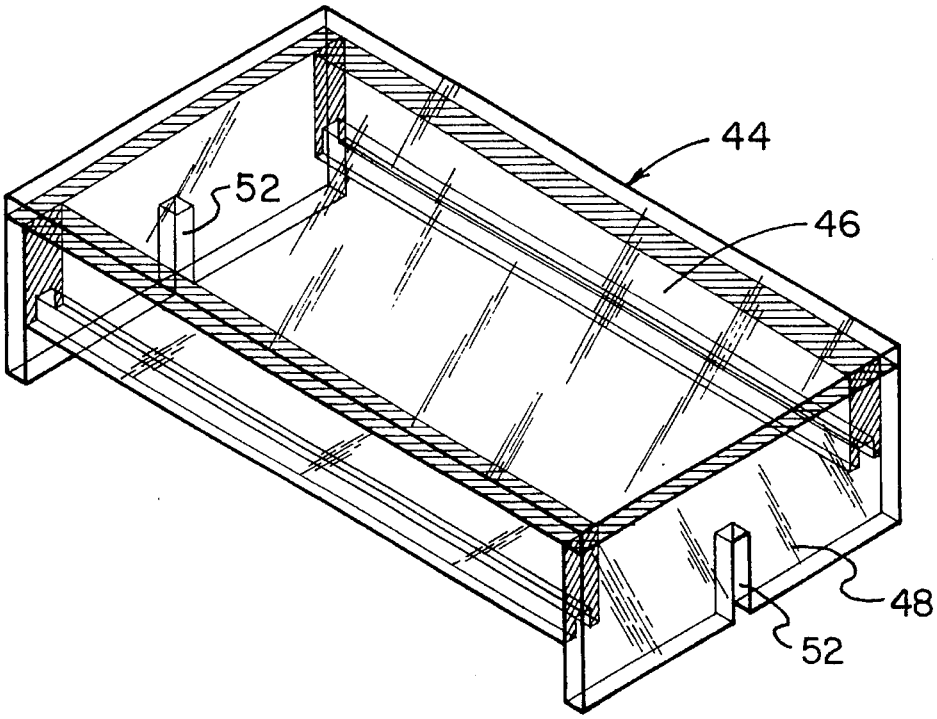
FIG. 11 is a perspective view of a plastic cover for use with the kitchen device for chopping and cutting as shown in FIGS. 1 and 2.

For proper functioning of the knife with its blades, such blades must be properly spaced. Such spacing is effective through spacer disks 18. The spacer disks are of a cylindrical configuration with all preferably of a common length for a particular application. The spacer disks are positioned on the rods 38 between adjacent blades. Note in particular FIG. 2.

An additional feature of the present invention in accordance with an alternate embodiment, includes a plastic cover or housing 44. The housing is fabricated of a transparent material so that when positioned over the knife and the materials being cut, the user may observe the action of the knife as well as the materials being cut, sliced or chopped. The housing is provided with an upper horizontal wall 46 and depending side walls 48, all of which are transparent. The housing also includes an open bottom for placement over the knife and the materials being cut. The entire housing is preferably fabricated of a transparent material such as a plastic, preferably plexiglas, for the user to observe the work being done.

Formed within the parallel side walls of the housing are a pair of recesses 52. The recesses extend upwardly from the centers of the lower edges of the side walls. The recesses function to receive the ends of the associated ends of the elongated central blade. The height of the recesses is such as to allow the blade and knife to be raised and lowered sufficiently to carry out the desired cutting result.

Figure 12:
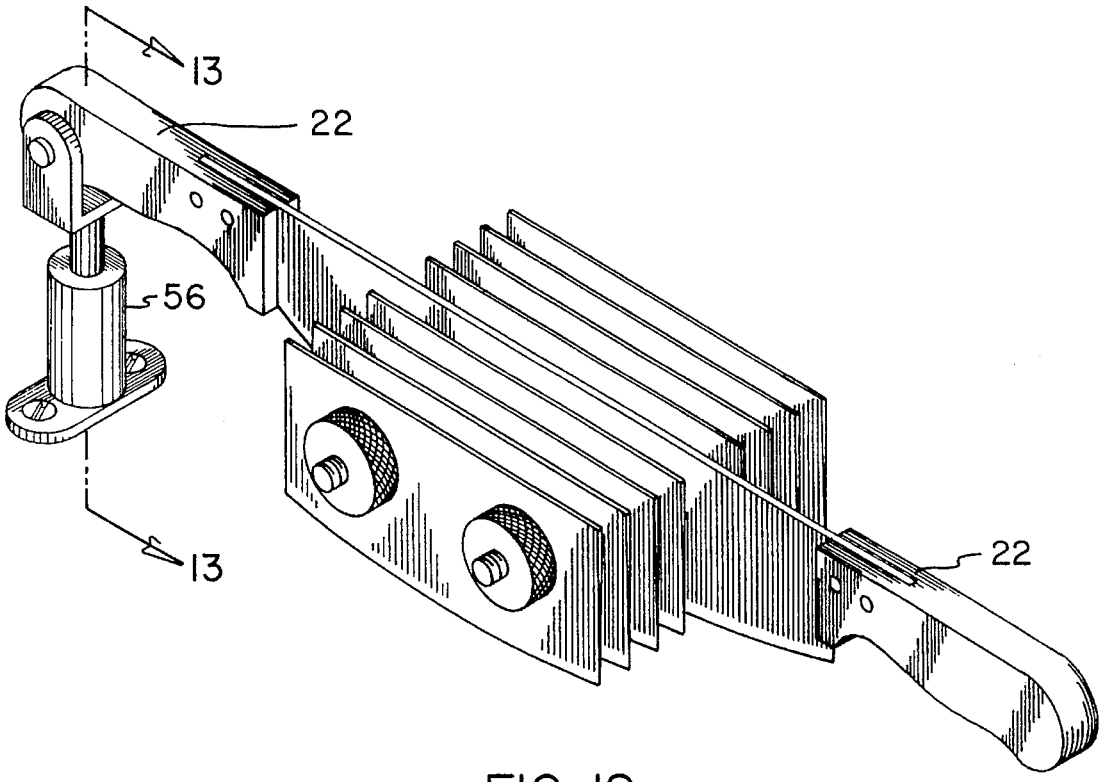
FIG. 12 is a perspective view of a kitchen device for chopping and cutting constructed in accordance with an alternate embodiment of the invention.
Figure 13:
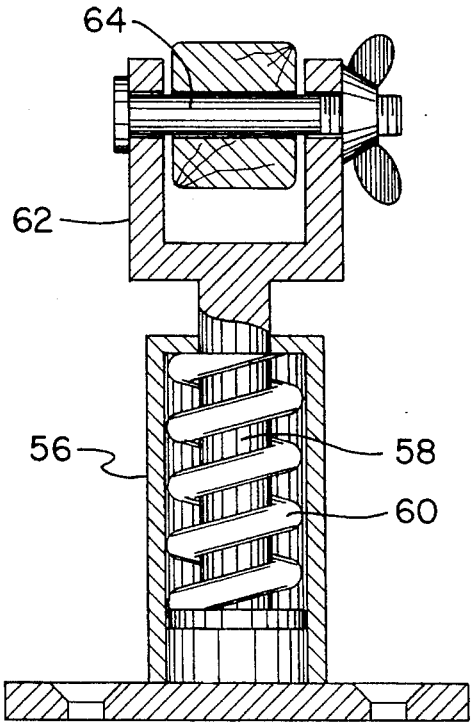
FIG. 13 is a sectional view of the kitchen device for chopping and cutting of the prior Figure taken along line 13—13 of FIG. 12.

The last feature of the present invention, the final alternate embodiment of the invention, is most readily seen by reference of FIGS. 12 and 13. Such feature is a mounting post 56. The mounting post is provided with apertures for coupling to a cutting board or other surface whereat the knife is to be utilized. The mounting post has a central vertical bore to receive a piston 58 and an associated spring 60. The spring tends to bias the piston downwardly as well as the end of the central blade 12 and one handle 22 to which it is coupled. The upper end of the piston is provided with a clevis 62 with apertures for receiving a pin 64. The pin extends through an aperture in the end of the handle. In this manner, the operation of the knife is simplified with less energy required by the user during the operation and use of the knife.

The present invention is a manually operated kitchen device for people who want convenience when chopping and slicing food but do not want the expense of an electric food processor. With its adjustable blade spacing, this product allows the user to perform a wide variety of tasks.

From end to end the preferred embodiment of the present invention measures roughly about 21 inches. It has plastic handles on each end measuring 7 inches long and 9/16 inches wide. A 7-inch long, 1/16 inch thick, stationary blade runs from handle to handle through the center of the device. This center blade is particularly suitable for cutting difficult items like turnips because it enables the user to get excellent leverage and bear down hard on the two end handles. All the other blades are 4 inches long and run parallel to the center blade on either side of it. These other blades are removable and are held in place by means of 1/8 inch threaded rods secured with knobs on each side.

Three different sizes of spacers can be used depending on how many blades will be used. The 2¼ inch spacers are appropriate when using two blades plus the middle blade. This combination is useful for cutting lasagna noodles, among other things. The ½ inch spacers allow the use of five blades. An example of an application here would be cutting strips of dough for topping a pie. The ¼ inch spacers are suitable for using nine blades. This setting is great for typical vegetable chopping and dicing.

An alternate design for the present invention would have two fixed blades ¼ inches apart on each side of the center blade. There would then be one additional blade that would be removable on each side for a total of seven blades. The primary advantage here will be that the number of spacers required will be reduced. The present invention is easy to use, assemble and disassemble and it is easier to clean out than other similar products when chopped vegetables get stuck between the blades.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A food chopper and slicer knife mechanism for kitchen use comprising:

an elongated central blade of an extended length having an elongated handle formed on each opposite end and a center therebetween with a pair of laterally spaced holes extending through the central blade, each hole being on an opposite side of the center of the central blade;

a plurality of supplemental blades smaller than the central blade positioned on opposite sides of the central blade and oriented parallel therewith, the supplemental blades each having ends and a center with a pair of laterally spaced holes extending therethrough, each hole being on an opposite side of the center of their respective supplemental blade, the holes being located approximately midway between the center and the ends of the supplemental blades, the central blade and supplemental blades having aligned cutting edges which are aligned parallel with one another when the holes are aligned about common axes;

coupling means including a pair of threaded rods, each positioned through a respective one of the pair of aligned holes of the central and supplemental blades with locking knobs positioned at the ends of the rods; and cylindrical spacer disks positioned on the rods between adjacent blades.

2. The apparatus as set forth in claim 1 in combination with:

a transparent housing having an upper wall and depending side walls, said side walls forming a space therebetween to extend around the supplemental blades, upwardly extending recesses formed in two of the side walls to receive the ends of the central blade.

* * * * *